US007946237B2

(12) United States Patent
Fong et al.

(10) Patent No.: US 7,946,237 B2
(45) Date of Patent: May 24, 2011

(54) METHOD FOR CHANGING THE DIRECTION OF TRAVEL OF A WATERCRAFT AND APPARATUS THEREFOR

(75) Inventors: Saik Hay Fong, Singapore (SG); Hong Soon Tan, Singapore (SG); Tee Peng Toh, Singapore (SG)

(73) Assignee: Singapore Technologies Dynamics Pte Ltd., Jalan Boon Lay (SG)

( * ) Notice: Subject to any disclaimer, the term of this patent is extended or adjusted under 35 U.S.C. 154(b) by 763 days.

(21) Appl. No.: 11/628,378

(22) PCT Filed: Jun. 3, 2005

(86) PCT No.: PCT/SG2005/000178

§ 371 (c)(1),
(2), (4) Date: Nov. 13, 2007

(87) PCT Pub. No.: WO2005/118390

PCT Pub. Date: Dec. 15, 2005

(65) Prior Publication Data

US 2009/0007832 A1 Jan. 8, 2009

(30) Foreign Application Priority Data

Jun. 3, 2004 (SG) ..... 200403108-4

(51) Int. Cl.

| | |
|---|---|
| ***B63H 25/00*** | (2006.01) |
| ***B63H 25/44*** | (2006.01) |
| ***B63B 21/02*** | (2006.01) |
| ***B63B 21/56*** | (2006.01) |
| ***B63B 39/03*** | (2006.01) |

(52) U.S. Cl. ..... 114/144 R; 114/125; 114/145 R; 114/242; 114/246

(58) Field of Classification Search ..... 114/242, 114/246, 248–250, 121, 125, 144 R, 145 R
See application file for complete search history.

(56) References Cited

U.S. PATENT DOCUMENTS

| | | | | |
|---|---|---|---|---|
| 3,345,971 | A * | 10/1967 | Stanwick | 114/242 |
| 4,030,441 | A * | 6/1977 | Nagata et al. | 114/242 |
| 4,949,663 | A * | 8/1990 | Lapeyre | 114/246 |
| 5,615,632 | A * | 4/1997 | Nedderman, Jr. | 114/330 |
| 6,413,128 | B2 | 7/2002 | Brabeck | |
| 6,591,744 | B2 | 7/2003 | Peek | |
| 6,698,374 | B1 | 3/2004 | Van Der Laan | |
| 2004/0065247 | A1 * | 4/2004 | Horton | 114/322 |

FOREIGN PATENT DOCUMENTS

JP 56039986 A * 4/1981

* cited by examiner

*Primary Examiner* — Ajay Vasudeva
(74) *Attorney, Agent, or Firm* — Karl F. Milde, Jr.; Eckert Seamans; Cherin & Mellott, LLC

(57) ABSTRACT

An apparatus for retarding and/or changing the direction of travel of a sailing vessel is disclosed. The apparatus includes a watercraft (10) with moveable flaps (12A, 12B, 12C) internal ballast tanks, solenoid banks (20) and explosive activated nut and bolt clamps. The watercraft (10) is manually navigated or navigated by remote control. A method of utilizing the watercraft (10) to retard and/or change the direction of travel of the sailing vessel is also disclosed.

20 Claims, 10 Drawing Sheets

METHOD FOR CHANGING THE DIRECTION OF TRAVEL OF A WATERCRAFT AND APPARATUS THEREFOR

FIELD OF THE INVENTION

The present invention relates to a method for changing the direction of travel of a watercraft and apparatus therefore. More particularly, the present invention relates to watercraft that is able to interrupt an errant water vessel and to change its original line of travel or movement. Yet more particularly, the present invention relates to an apparatus and a method of countering the threat of hijacked vessels used as weapons of destruction.

BACKGROUND OF THE INVENTION

Just as aircrafts have been used as a weapon or missile to attack or destroy buildings or other large structures, it is envisagable that ships, tankers or watercrafts, harbours, port installations and the like can be destroyed or seriously damaged by the use of tankers or large ships as missiles of attack. This is especially so when such tankers or ships are loaded with inflammable materials, such as fuel oil, inflammable chemicals, etc.

Thus if such a tank or ship is used as a missile, then it is necessary to either stop the travel or change the direction of travel of such sailing vessels, so that collision with the targeted object is avoided. The steering of such errant vessel away from the intended target has to be executed swiftly.

U.S. Pat. No. 6,698,374 discloses a system of tugboats to externally steer and guide a large shipping vessel. This method is disadvantageous in that it is unable to quickly steer a large vessel that is traveling at high speed. The towing cable may snap. In addition it may not be possible to connect the cable to the large vessel, as access to the vessel would be denied.

U.S. Pat. No. 6,591,774 discloses a method and apparatus for protecting ships and harbours from attack by sailing vessels. A barrier, fence or obstruction is constructed around the ships or habour to be defended, either floating on the surface above and or beneath the surface of the water. When a boat attempts to force its way through the barrier, the barrier uses the momentum of the vessel against itself by using the forward momentum of the attacking vessel in such a manner as to divert, impede, stop, damage or destroy the vessel. This system of capturing and/or stopping the vessel is only suitable where the attacking vessel is a small vessel. It is not suitable for arresting large shipping vessels.

U.S. Pat. No. 6,413,128 discloses a device for changing the direction of travel of a watercraft. The device includes a gondola-like underwater housing having a container favourable in terms of flow outside the hull by the watercraft, and is connected to the hull of the watercraft by a shaft. The change in direction of travel of the watercraft is brought about by a pivoting motor acting on the shaft, and the use of high energy fluid jets in the gondola-like structure. The latter is a permanent device attached to the watercraft to enhance steering at low noise.

These methods and the apparatus used are not suitable when the errant sailing vessel is traveling fast and with a large momentum. There is a need for alternate means of providing external steering that will overcome these limitations. There is a need to have a smaller watercraft to steer and change the direction of a large vessel regardless of the actual traveling momentum and rudder position of the vessel. There is a further need to override the command of a hijacked ship and to prevent it from traveling to a danger area in the sea or near the sea ports.

The present invention endeavours to provider a method and apparatus for intercepting and docking with an errant sailing vessel. A further preferable aspect of the invention is to change the direction of sail of the errant vessel.

It is another object of the present invention to alleviate at least one disadvantage associated with the prior art.

Any discussion of documents, devices, acts or knowledge in this specification is included to explain the context of the invention. It should not be taken as an admission that any of the material forms a part of the prior art base or the common general knowledge in the relevant art in Singapore or elsewhere on or before the filing date of the disclosure and claims herein.

SUMMARY OF THE INVENTION

The present invention discloses an apparatus for changing the direction of travel of a sailing vessel. The apparatus consists of a watercraft which includes at least one moveable flap mounted at the side, bottom of the watercraft or at fore or aft section of the watercraft; at least one internal ballast tank; at least one solenoid bank; and at least one explosive activated or quick acting bolt and nut or mechanical clamping means.

Preferably the watercraft includes at least one moveable flap mounted at its side, at least one moveable flap mounted at its bottom and at least one moveable flap mounted at its fore or aft section.

The moveable flap at the fore or aft section of the watercraft is mounted in a manner such that in a first position, the flap is inclined from a top point to a lower point proximate to the bottom of the watercraft and in second position, the flap is retractable towards the top point, to expose a vertical wall of the watercraft.

The explosive activated nut and bolt clamping means includes: an elongated shaft extending from inside the watercraft to the outside through its hull; a bolt attached to the shaft and in close proximity to inside wall of the watercraft; a nut with a collapsible sleeve mounted on the shaft section outside the watercraft; an explosive embedded tip or quick acting nut and bolt or mechanical clamping means imported on the shaft; a point of weakness along the shaft; and the shaft is rotatably mounted to a motor means.

In a preferred form of the present invention, the watercraft comprises of a vector propulsion means such as thrust vectoring waterjets, generating directional thrust and in turn assists in the steering of the errant vessel or keeping the watercraft close to the errant vessel's hull. These directional waterjets can also be directed at the flap to generate the hydrodynamic side thrust to yaw the vessel.

In another aspect, the present invention discloses a method of changing the direction of travel of a sailing vessel comprising the steps of: bringing a watercraft as described above alongside the hull of the sailing vessel; submerging the watercraft by opening of at least one internal ballast tank, bringing the watercraft in electro-mechanical contact with the hull of the sailing vessel by activating at least one solenoid bank; mechanically securing the watercraft to the sailing vessel, by activating at least one explosive tipped nut and bolt or other quick acting mechanical means; and resisting the travel and/or changing the direction of travel of the sailing vessel, by opening of at least one moveable flap of the watercraft.

Preferably three flaps are opened wherein one moveable flap is opened at the bottom and one moveable flap is opened at side of the watercraft; and one flap at fore or aft section of the watercraft is moved from an inclined position to a horizontal position to expose a vertical wall at the aft or fore section of the watercraft respectively. The flap at the bottom of the watercraft can also be oriented in a vertical position and it can be stowed in the watercraft by rotating at the attachment point.

In another form of the present invention, the thrust vectoring waterjets in the watercraft are activated to assist in the steering of the errant vessel or keeping the watercraft close to the errant vessel's hull. It can also help to generate the hydrodynamic side thrust to yaw the vessel by impinging the waterjets at the flap.

To mechanically secure the watercraft to the sailing vessel the explosive is triggered to create an opening in hull of the sailing vessel, a bolt secured to a shaft is introduced into the opening created earlier and the shaft is rotated by means of a motor to wedge a collapsible sleeve against the hull of the sailing vessel. The hulls of the watercraft and the sailing vessel are brought together into close proximity and mechanically secured together. The shaft is preferably sheared off at a point of weakness along its length when the bolts are tightened.

The watercraft houses power generation motors to generate electrical power to energise the solenoid banks and to operate motors which rotate the explosive tipped shafts and to operate the propeller. The sailing or navigation of the watercraft can be manually handled by an operator or it can be unmanned and be remotely handled.

Other aspects and preferred aspects are disclosed in the specification and/or defined in the appended claims, forming a part of the description of the invention.

In essence, the present invention provides means for externally steering and/or changing the direction of a vessel regardless of the actual traveling momentum and rudder position of the vessel.

The present invention has been found to result in a number of advantages, such as the present invention:

- employs the concept of physical hydrodynamics drag or lift via watercraft to cause the vessel to yaw. It overcomes the limitations imposed by the size of the large vessel on the use of current attachments such as cable or anchors.
- is designed for modular deployment. Depending on the tonnage, maximum cruise speed and the desired turning radius of the vessel to be engaged, one or more of such watercraft can be deployed to achieve the mission most effectively. As such, these watercrafts can effectively engage vessel with 300,000 ton or more with maximum cruise speed of 15 to 20 knots.
- minimizes and reduces collateral damage to the vessel and environmental hazard due to the potential pollution or blockage of the fairway by sinking the vessel containing flammable goods.

Another aspect of the invention is, whilst the aforementioned docking or attaching means, such as the explosion-propelled nut-and-bolt clamping means, electro-magnetic or electro-mechanical attaching means, ballast, hull drilling and vacuum suction means, are employed in conjunction with deploying pivoting flaps, hydrofoils, or rudder-like blades to alter or influence the vessel's course, it is to be understood that the aforementioned docking means may be employed singularly or in combination without the need for the rudder-like blades. The watercraft comprising the apparatus of our invention may simply deploy any one or combination of the aforementioned docking means for tugging purposes or simply for boarding by security personnel in attempting to regain control of the errant vessel.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

Further disclosure, objects, advantages and aspects of the present application may be better understood by those skilled in the relevant art by reference to the following description of preferred embodiments taken in conjunction with the accompanying drawings, which are given by way of illustration only, and thus are not limitative of the present invention, and in which.

DETAILED DESCRIPTION OF THE INVENTION

The invention relates to a system comprising a watercraft that is collectively (a) designed to be operated by man or unmanned control (b) for high maneuverability and speed to enable quick interception of a large vessel (c) that can be securely fastened to the sides of the vessels once it is alongside the larger vessel and (d) that can change its configuration to provide a high hydrodynamic drag or side thrust surface upon command.

Figure 1A:
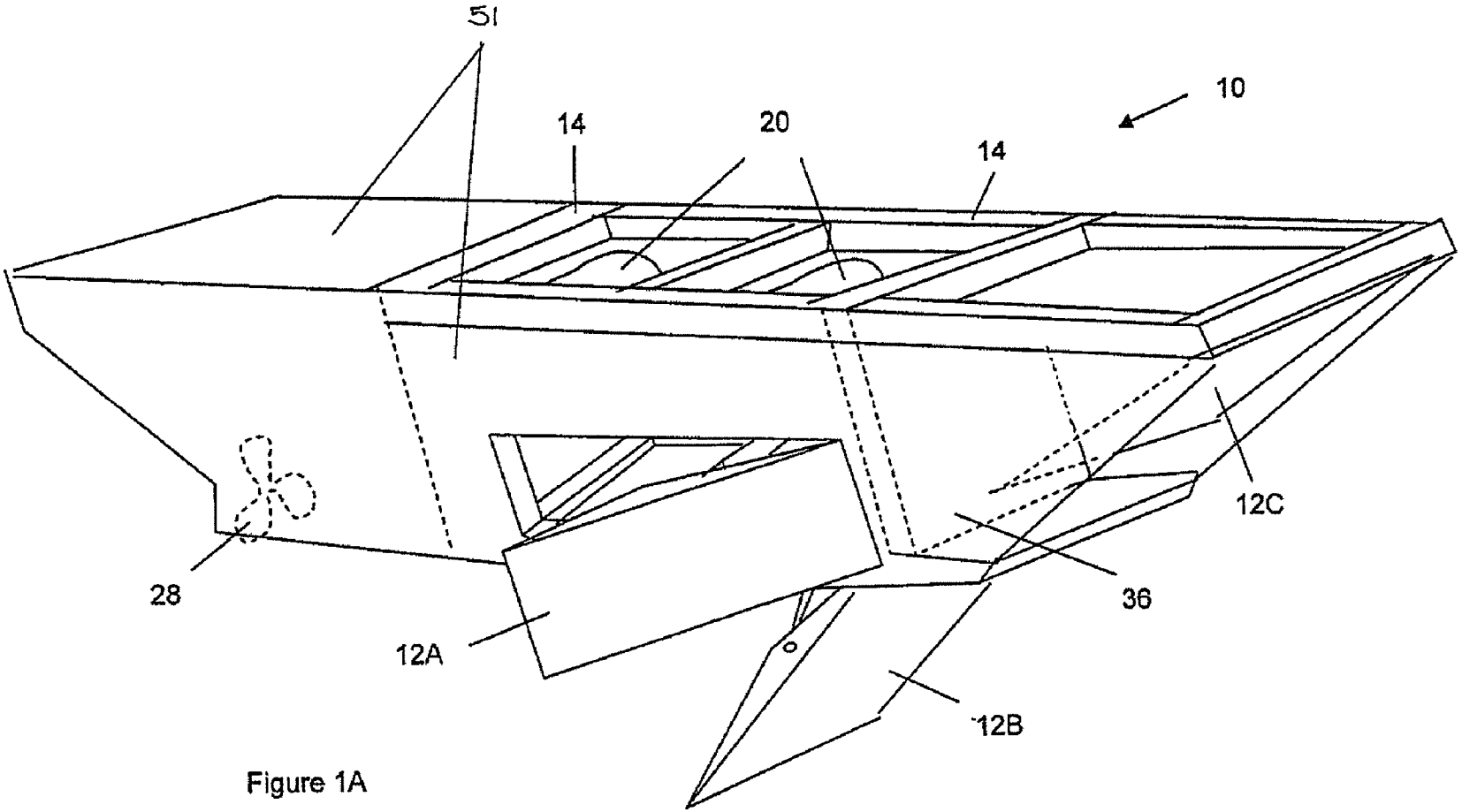
FIG. 1A illustrates schematically the external configuration of a watercraft.
Figure 1B:
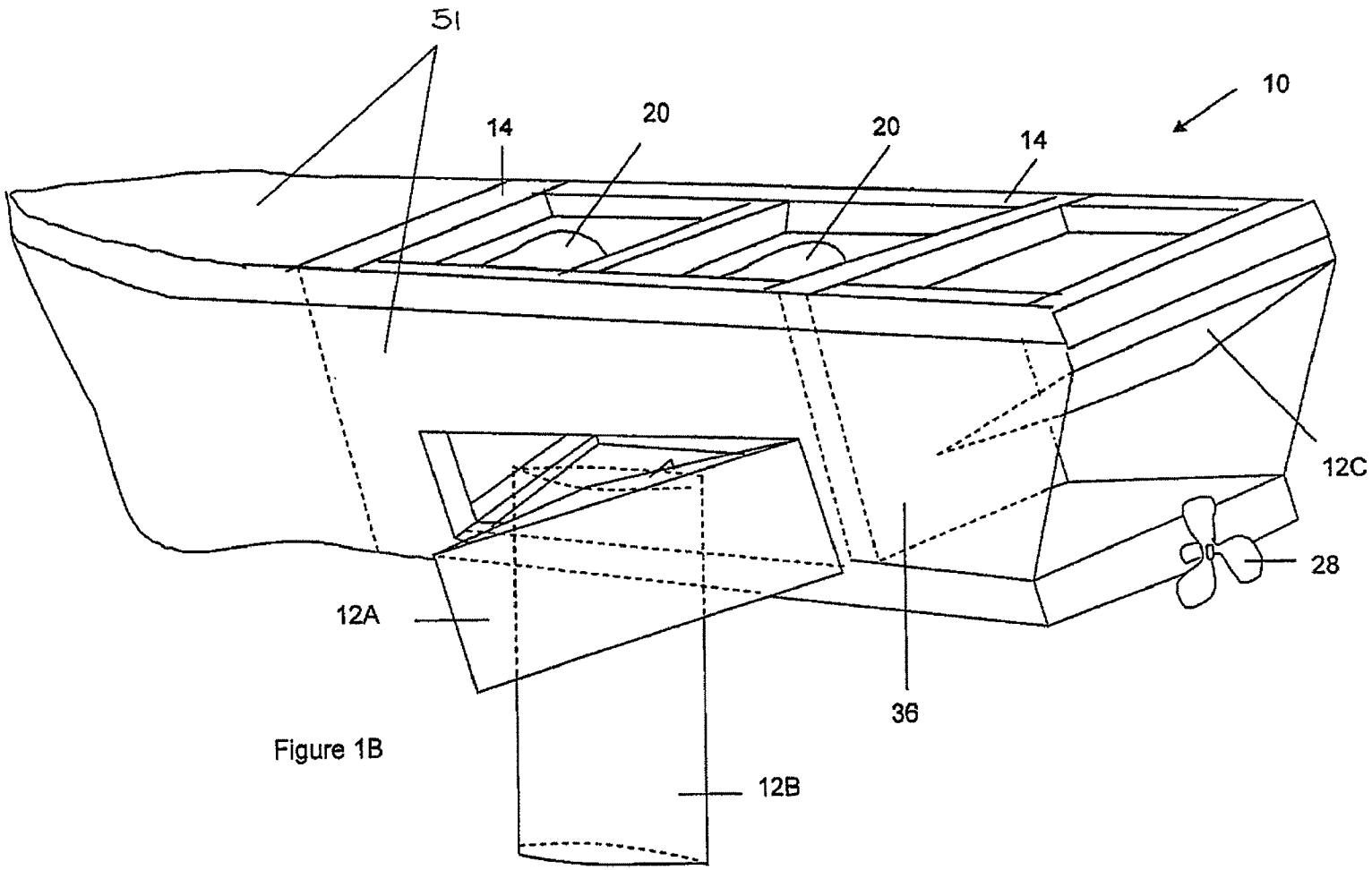
FIG. 1B illustrates schematically the external configuration of another embodiment of a watercraft.
Figure 1C:
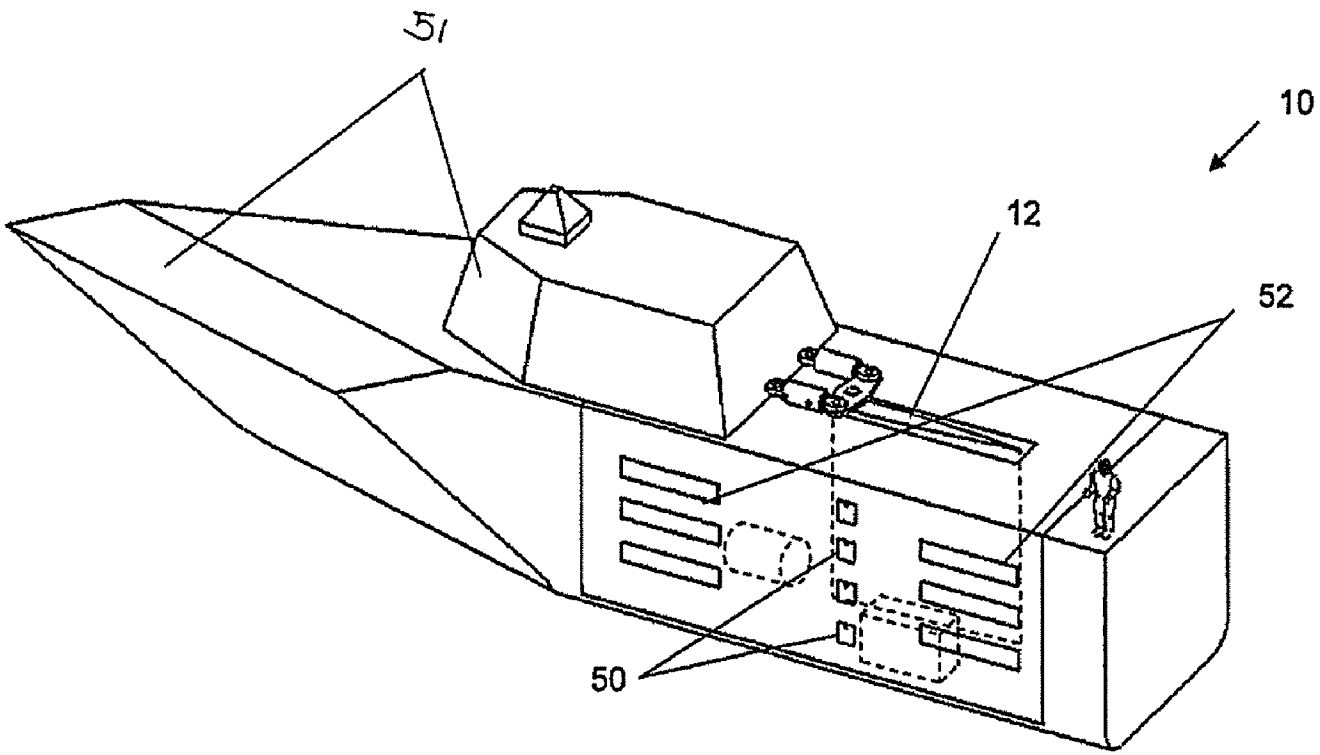
FIG. 1C illustrates schematically the configuration of yet another embodiment of a watercraft.
Figure 2:
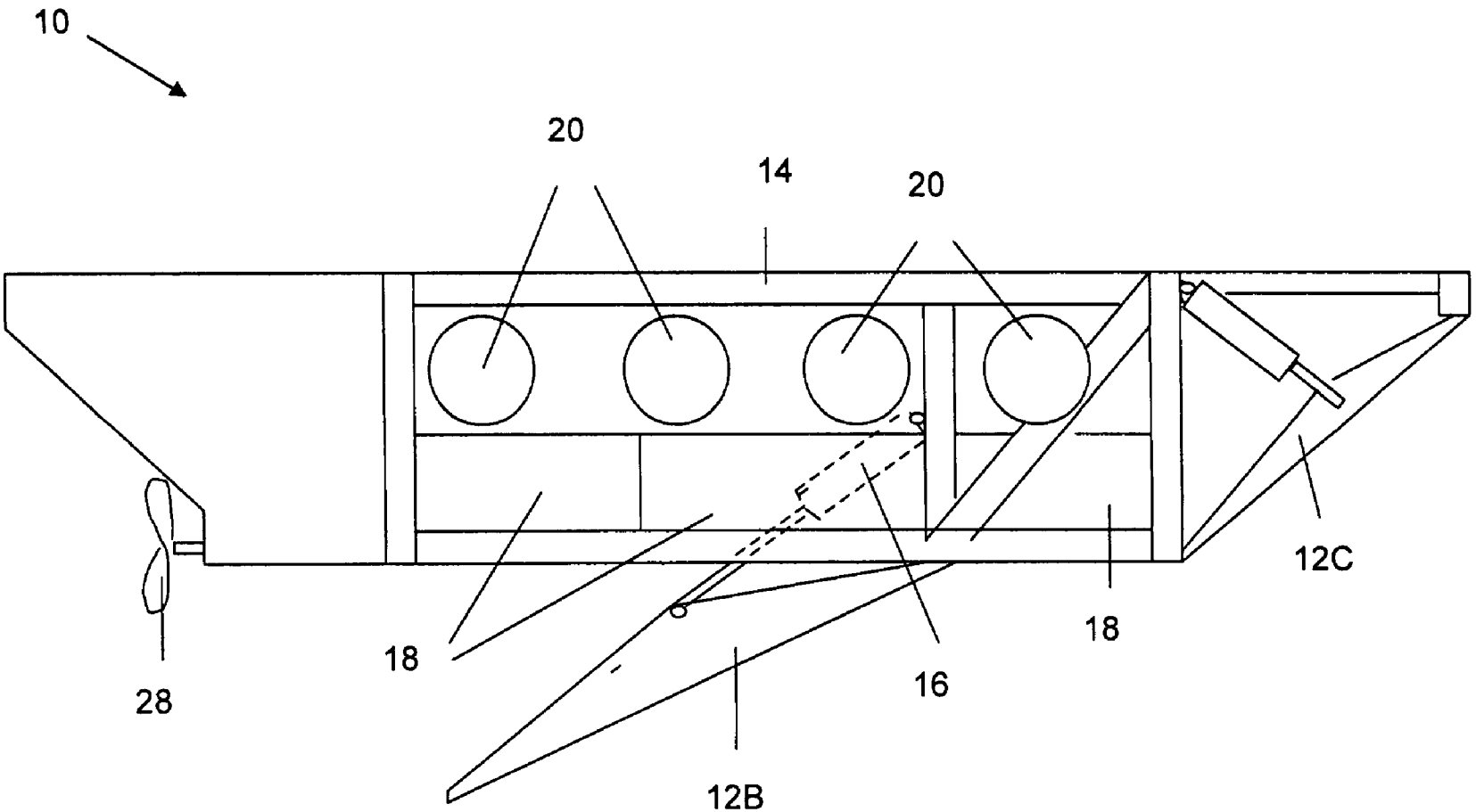
FIG. 2 illustrates schematically a side view of the watercraft.

The watercraft according to this invention can be of multiple designs. In one form, it can be a rigid structure which is shaped as a voluminous vessel as shown in FIGS. 1A and 2. The watercraft 10 includes a plurality of moveable hydraulic or gear motorised flaps 12A, 12B and 12C provided at the lateral sides, at bottom of the watercraft 10 or at fore section of the watercraft 10. Each flap 12 is hinged joined to a frame structure 14 of the watercraft 10 and is secured to at least a hydraulic piston 16 or gears (not shown). FIG. 1B illustrates another embodiment of the watercraft 10, wherein the flap 12C is provided at the aft section of the watercraft 10 and 12B is oriented in a vertical position at the bottom of the watercraft 10. FIG. 1C illustrates yet another embodiment of the watercraft (10) according to the invention. A watercraft size is generally estimated to be about 30 meters long and 6 meters wide for the good speed, agility and maneuverability.

Figure 3:
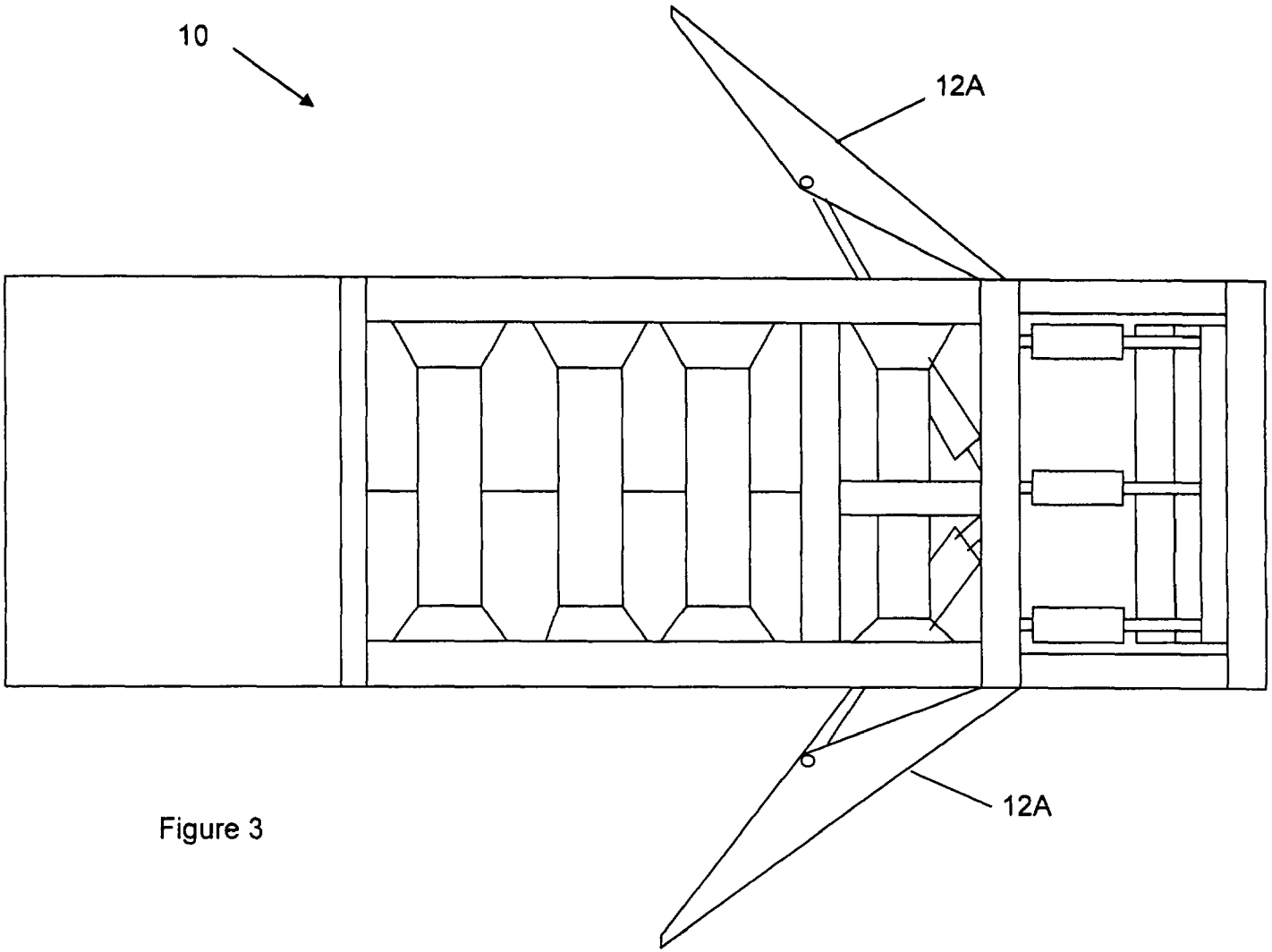
FIG. 3 illustrates schematically a plan view of the watercraft, with open flaps at both sides of the watercraft.

FIG. 3 illustrates a plan view of the watercraft 10 with moveable flaps 12A at both sides of the watercraft 10, enabling the watercraft 10 to be maneuvered to either sides of the sailing vessel.

The watercraft 10 includes a plurality of internal ballast tanks 18 at the lower region of the watercraft 10 as illustrated in FIG. 2. The watercraft 10 further includes a plurality of solenoid banks 20. Each solenoid bank 20 is mounted with the longitudinal axis of its shaft mounted widthwise of the watercraft 10. The terminal edge of each solenoid bank 20 is in contact with the side walls of the watercraft 10.

Figure 4:
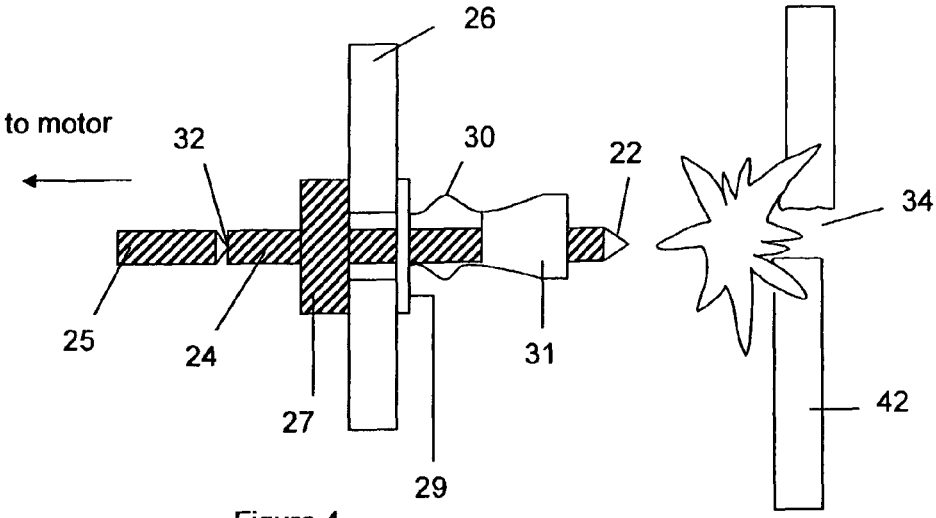
FIG. 4 illustrates explosive at bolt's tip to create an opening at a hijacked vessel's hull.

Referring to FIG. 4, the watercraft 10 further includes a plurality of means to discharge explosive 22 disposed at the tip of bolt 24. The bolts 24 are mounted on preferably on each side hull 26 of the watercraft 10 and extend outside the hull upon command. A nut 31 with a collapsible sleeve 30 is provided at each of the bolts 24.

Alternatively a quick acting nut and bolt can be secured to the terminal portion of the shaft extending outside the hull of the watercraft 10. Yet in another aspect of the invention, a mechanical clamping means is provided at the terminal portion of the shaft outside the hull of the watercraft 10.

Figure 7:
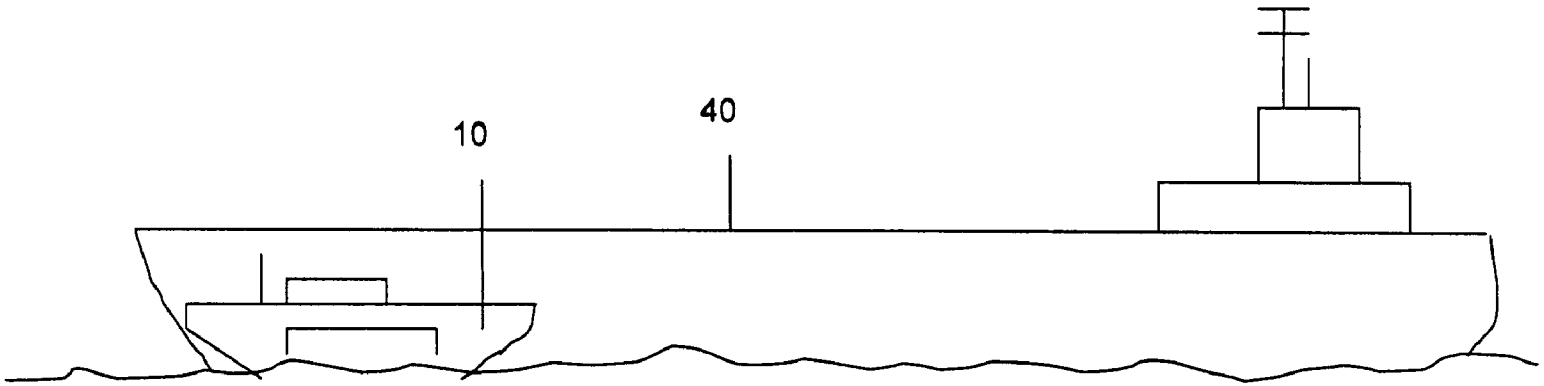
FIG. 7 illustrates the watercraft position itself alongside a side of hijacked vessel near the bow.

The method of use of the watercraft 10 and other features of the watercraft 10 not hereinbefore described will be now described. During high speed maneuver, the watercraft 10 will be powered using its own self propelling propeller 28. Referring to FIG. 7, the watercraft 10 once deployed, will engaged the hijacked vessel 40 by traveling towards the bow of the hijacked vessel 40. Once aside the hijacked vessel 40, or any vessel where direction of travel is to be altered by force, the watercraft 10 will position itself alongside the hijacked vessel 40, preferably at the stern or bow side of the hijacked vessel 40. In an alternate embodiment (not shown), the watercraft 10 as illustrated in FIG. 1B, once deployed will position itself with its aft section facing the direction of flow, i.e. in the opposite direction of the hijacked vessel 40, preferably at the stern or bow side of the hijacked vessel 40.

Figure 8:
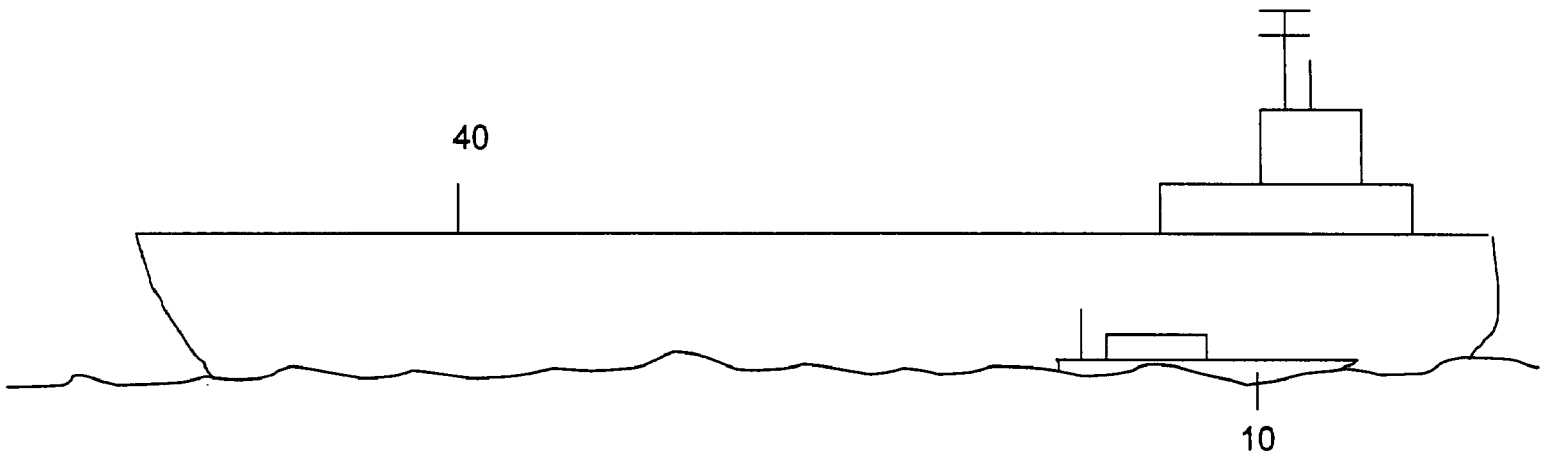
FIG. 8 illustrates the watercraft submerged and drifted alongside the hijacked vessel.
Figure 9:
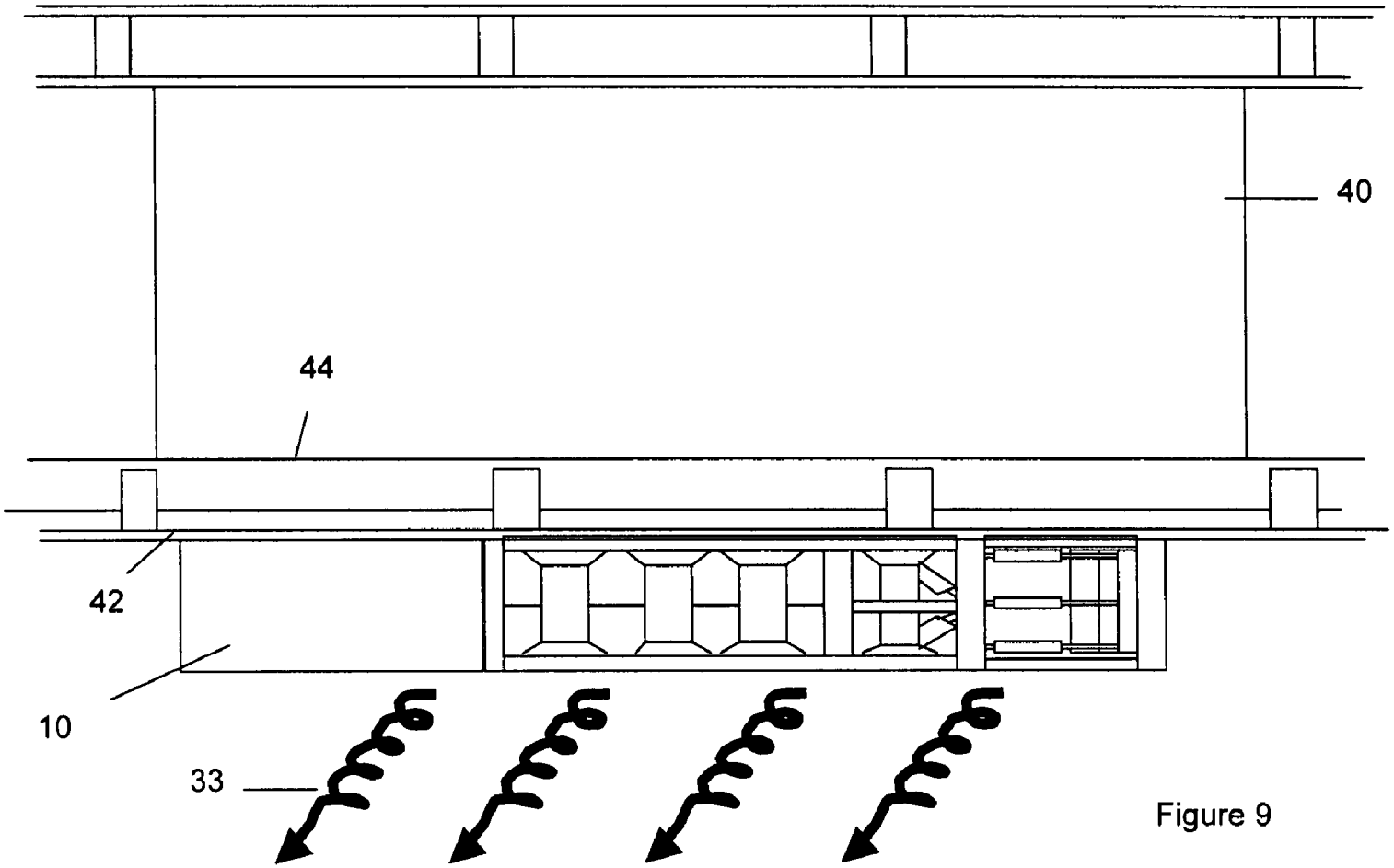
FIG. 9 illustrates schematically a plan view of the watercraft parked alongside the hijacked vessel to be in close contact by lateral waterjets.

Referring to FIG. 8, when a large force is required to alter speedily the direction of the hijacked vessel 40, for example, the hijacked vessel 40 is traveling at maximum cruise speed, the watercraft 10 is then partially submerged by opening up of its internal ballast tanks 18, allowing seawater to flow. The activation of the ballast tanks 18 depends on the tonnage, cruise speed and the desired turning radius of the hijacked vessel 40. During this time, the watercraft is maintained in close contact or proximity with the sidewall of the hijacked vessel 40 through the use of vectored propulsion. The vectored propulsion can be achieved by a system of thrust vectoring water jets 33 as illustrated in FIG. 9. The action of the water jets 33 will take the watercraft inwards towards the sidewall of the hijacked vessel 40, so that the wall of the watercraft 10 is in contact with the wall of the hijacked vessel 40.

Figure 10:
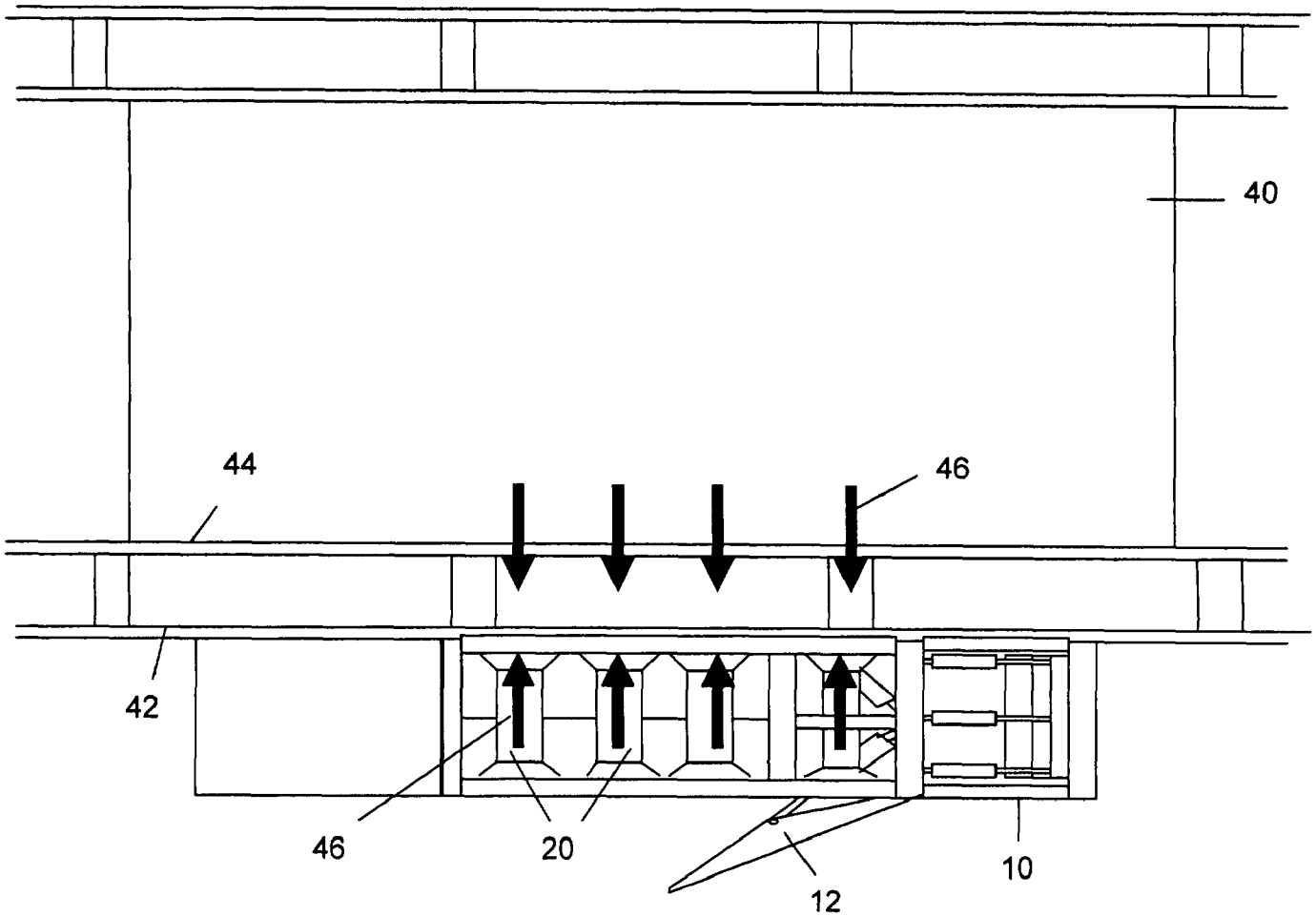
FIG. 10 illustrates schematically a plan view of the diversion watercraft, the hijacked vessel, and the electromagnetic attraction between the watercraft and the hijacked vessel.

Referring to FIG. 10, when the watercraft 10 reaches the desired section of the hijacked vessel 40, an electromagnetic attraction between the watercraft 10 and the hijacked vessel 40 will be generated through powering up a series of heavy-duty solenoid banks 20 that are installed within the watercraft 10. The electromagnetic force, generated by the plurality of solenoid banks 20 will temporarily secure the watercraft 10 to the hijacked vessel 40 at the desired location of the hijacked vessel 40, preferably the stern side, to create the maximum moment arm for turning.

All modern vessels have double hull design. As illustrated in FIG. 10, the hijacked vessel 40 having double hull vessel includes two independent hulls 42, 44, one inside the other, with the two hulls 42, 44 spaced from one another and a common deck extending over the hulls. Both hulls include watertight, pressure-resistant side walls and bottoms. The explosive tipped shaft only punctures the outer hull of the hijacked vessel 42.

While the two vessels are held together by electromagnetic force 46, a system of explosive activated or quick acting mechanical bolts 24 held in the watercraft 10 are activated to create openings on the outer hull 42 of the hijacked vessel 40, allowing fastening of bolt and nut to further secure the watercraft 10 to the hijacked vessel 40. Alternatively the vessels can be mechanically clamped. Once mechanically fastened, the watercraft 10 is inseparable from the hijacked vessel 40.

Figure 5:
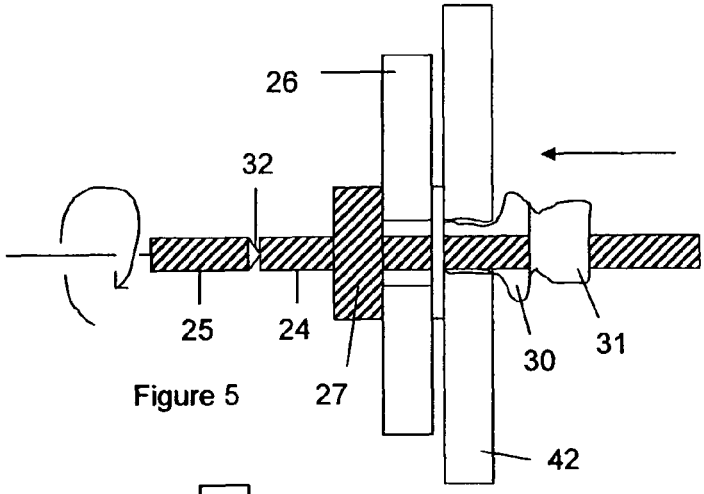
FIG. 5 illustrates a collapsible sleeve of the bolt deforming and wedging into the hijacked vessel's hull.
Figure 6:
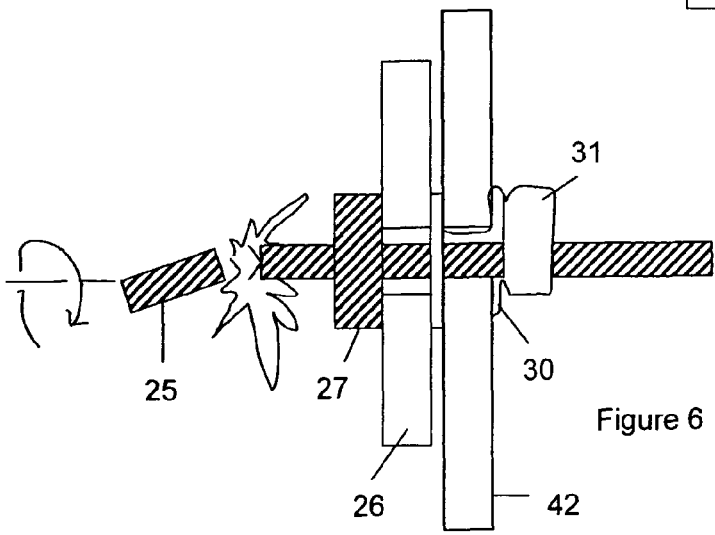
FIG. 6 illustrates the separation of bolt with motor when required torque is achieved.

Referring to FIGS. 4 to 6, the explosive-activated mechanical bolt 24 consists of an elongated shaft 25 extending from within the watercraft 10 through the side hull 26 of the watercraft 10. The shaft 25 is secured in position by a bolt 27 on the inner wall of the watercraft 10 and a water sealant member 29 on the outside wall. The outside exposed section of the bolt includes a nut 31 with collapsible sleeve 30. The shaft 25 includes a point of weakness 32 along its length and is connected to a motor (not shown). The explosive at the tip of the bolt can be detonated by a fuse initiated electronically upon command. The motor is powered by the onboard generator to provide a quick and powerful means of turning and tightening the bolt and nut.

On triggering the explosive head 22, an opening 34 is created on the outer hull 42 of the hijacked vessel 40. The opening 34 is sufficient to accommodate the diameter of the shaft of bolt and nut 31 to go through. Once the shaft 25 and nut 31 is inside the hijacked vessel's hull, the bolt 24 is rotated by means of the motor secured to the shaft 25 as illustrated in FIG. 5. This rotational movement of the shaft tightens the nut 31 against the outer hull 42 of the hijacked vessel 40 and simultaneously the collapsible sleeve 30 of the bolt deforms and wedges onto the opening 34 created by the explosion. Referring to FIG. 6, further rotation of the shaft 25 results in the shearing of the shaft 25 at the point of weakness 32, resulting in the portion of the shaft 25 being detached free from the rest of the shaft 25.

Once the watercraft 10 is securely attached to hijacked vessel 40 by the plurality of nuts and bolts described earlier, another series of maneuvers are put in action. The flaps 12 which may now partially or fully be submerged to create the optimum hydrodynamics drag or side thrust depending on the tonnage, cruise speed and the desired turning radius of the hijacked vessel. Hydraulically or other electro-mechanically activated flaps 12A, 12B at the side and the bottom of the watercraft 10 respectively are pushed outwards by hydraulic pistons or gear means. The flap at the fore section 12C is withdrawn towards the body of the watercraft (see FIG. 1A) to expose a large vertical wall 36 against the direction of flow. Alternatively, the flap at the aft section of the watercraft 10 can be activated to form a vertical wall when the watercraft 10 deployed is traveling in the opposite direction of the travel of the hijacked vessel 40 (see FIG. 1B). The action of the flaps 12A, 12B, 12C causes an instantaneous increase in the hydrodynamic drag or side thrust on one side of the hijacked vessel 40. The amount of incremental drag can be varied by moving these flaps inward and outwards or left and right when the flap 12B is oriented in a vertical position. Thus the activation of the flaps 12, forces the hijacked vessel 40 to change its course of direction, beyond the operation of the rudder of the hijacked vessel 40.

Figure 11:
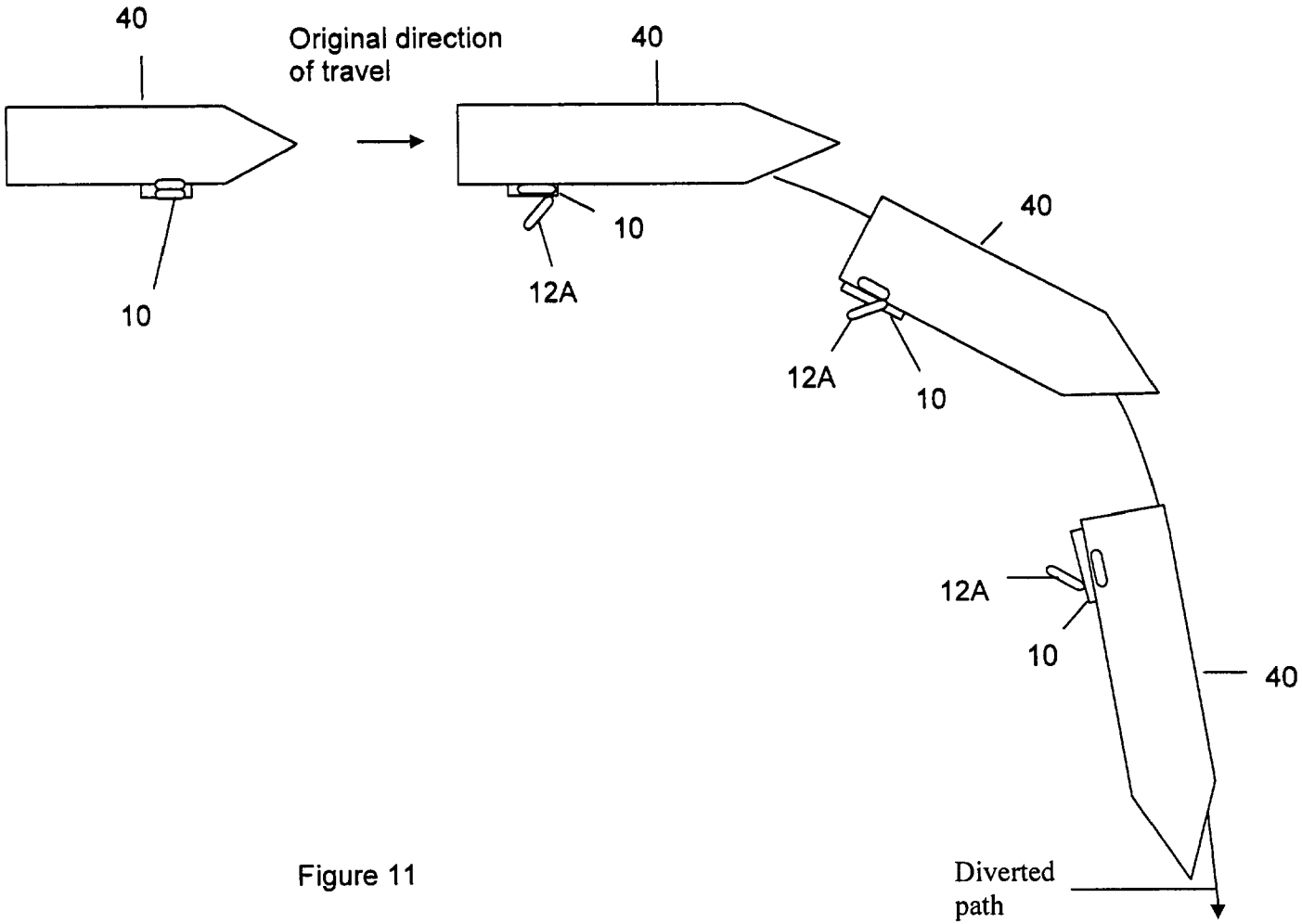
FIG. 11 illustrates schematically the diversion of path of the hijacked vessel with the watercraft secured to the hijacked vessel.

FIG. 11 illustrates schematically the diversion of the path of the hijacked vessel 40 with the watercraft 10 secured to the hijacked vessel 40. To steer the hijacked vessel 40, one or more of such watercraft 10 can be deployed at one or both sides of the hijacked vessel 40 to steer and overpower the hijacked vessel 40 to the desired direction.

The watercraft 10 carries with it the necessary equipment and system to operate the solenoid banks 20, the motor to rotate the shaft 25, the hydraulic flaps or the electro-mechanically activated flaps 12 and the ballast tank 18. The navigation of the watercraft 10 can be done manually or by remote control.

In another embodiment of the present invention, the watercraft 10 is equipped with a self protection system such as amour plated to protect the personnel or component onboard from small to medium armament fired from automatic rifle and Rocket Propelled Grenade launcher. The personnel onboard can also evacuate from the watercraft via an escape capsule.

In yet another embodiment of the present invention, mechanical drill rigs 50 can be used to drill through the hull of the hijacked vessel. Upon successful puncturing the hull, the drilling rigs 50 can allow the drill rod to extend into the hull and wedged onto the web frame of the hijacked vessel. As the web frame of the vessel is the strongest part of the ship structure, the drilling rod can be used as structure for bolting the ship to the watercraft.

It is estimated that for a vessel of length 276 m, 40 m wide with a design draft of 12 m and a tonnage of 73,000 metric ton traveling at 15 knots, the required flap for yawing is less than 5 m by 5 m. With the use of 4 drilling rods of diameter 100 mm each will be able to hold onto the vessel to cause the hijacked vessel to turn at a radius of 2 km. These drill rigs 50 can be modified from existing commercial drill rig that is being used for geo-technical or environmental exploration.

The initial holding force required for the drilling operation can be provided by vacuum suction pads 52. Using vacuum pads 52 each with a suction capability of 1.4 ton (eg ANVER vacuum pad PA1834), 30 of such pads will be sufficient for the operation. Once the drills are wedged onto the wedge frame of the vessel, the pads can be used to stabilize the watercraft and help the drilling rod to adhere to the vessel when the flap is deployed. Alternatively, larger number of smaller diameter drills can also be used to replace the 4 large diameter drills. 60 of such smaller conventional drill rig each with a diameter of 25 mm may be sufficient.

As a typical estimate of the amount of force required for effectively yawing a hijacked vessel, for a vessel of a length of 276 m, 40 m wide with a design draft of 12 m and a displacement tonnage of 73,000 metric ton traveling at 15 knots, the required yawing moment to turn the vessel at a turning radius of 2 km is about $1.0\times10^8$ Nm. With a flap 12, 5 m by 5 m positioned at the stern of the hijacked vessel with a 45 degree angle of attack with respect to the flow stream will be sufficient.

While this invention has been described in connection with specific embodiments thereof, it will be understood that it is capable of further modification(s). This application is intended to cover any variations uses or adaptations of the invention following in general, the principles of the invention and including such departures from the present disclosure as come within known or customary practice within the art to which the invention pertains and as may be applied to the essential features hereinbefore set forth.

As the present invention may be embodied in several forms without departing from the spirit of the essential characteristics of the invention, it should be understood that the above described embodiments are not to limit the present invention unless otherwise specified, but rather should be construed broadly within the spirit and scope of the invention as defined in the appended claims. Various modifications and equivalent arrangements are intended to be included within the spirit and scope of the invention and appended claims. Therefore, the specific embodiments are to be understood to be illustrative of the many ways in which the principles of the present invention may be practiced. In the following claims, means-plus-function clauses are intended to cover structures as performing the defined function and not only structural equivalents, but also equivalent structures. For example, although a nail and a screw may not be structural equivalents in that a nail employs a cylindrical surface to secure wooden parts together, whereas a screw employs a helical surface to secure wooden parts together, in the environment of fastening wooden parts, a nail and a screw are equivalent structures.

"Comprises/comprising" when used in this specification is taken to specify the presence of stated features, integers, steps or components but does not preclude the presence or addition of one or more other features, integers, steps, components or groups thereof.

What is claimed is:

1. An apparatus for changing the direction of travel of a sailing vessel, the said apparatus consisting of a watercraft which includes:

(i) at least one moveable flap mounted on at least one of a side of the watercraft, a bottom of the watercraft and a fore or aft section of the watercraft;

(ii) at least one solenoid bank;

(iii) at least one quick acting means for mechanical attachment to the sailing vessel; and (iv) at least one internal ballast tank; and wherein when the watercraft is in close proximity of the sailing vessel, the at least one solenoid bank is energised so as to electromagnetically bring into contact the wall of the watercraft and the wall of the sailing vessel, the at least one quick acting means is activated to mechanically secure the watercraft to the sailing vessel, the at least one internal ballast tank is opened to submerge the watercraft alongside the sailing vessel, and the at least one moveable flap is moved to a position to at least one of retard forward movement and change the direction of travel of the sailing vessel.

2. An apparatus as claimed in claim 1, wherein the watercraft includes at least one moveable flap mounted at its side, at least one moveable flap mounted at its bottom and at least one moveable flap mounted at its fore or aft section.

3. An apparatus as claimed in claim 1, wherein the moveable flap at the fore or aft section of the watercraft is mounted in a manner such that in a first position, the flap is inclined from a top point to a lower point proximate to the bottom of the watercraft and in second position, the flap is retractable towards the top point, to expose a vertical wall of the watercraft.

4. An apparatus as claimed in claim 1, wherein the quick acting mechanical attachment means includes:

(i) an elongated shaft extending from inside the watercraft to the outside through its hull;

(ii) a bolt attached to the shaft and in close proximity to inside wall of the watercraft;

(iii) a nut with a collapsible sleeve mounted on the shaft section outside the watercraft;

(iv) a point of weakness along the shaft;

(v) motor means for rotating the shaft; and (vi) explosive means disposed on the shaft section outside the watercraft, and beyond the collapsible sleeve, for piercing in the hull of the sailing vessel.

5. An apparatus as claimed in claim 1, wherein the watercraft is equipped with a self protection system in the form of armor plate.

6. The apparatus as claimed in claim 1, further comprising a mechanical attachment means including at least one of:

an electromagnetic attaching means as generated by the solenoid bank;

an explosive-propelled hull-piercing nut-and-bolt clamping means;

hull drilling means; and vacuum suction means.

7. An apparatus for establishing mechanical contact between a sailing vessel and a watercraft, comprising the following attachment means:

an electromagnetic attaching means as generated by a solenoid bank; and an explosive-propelled hull-piercing nut-and-bolt clamping means; and means for deploying the attachment means without deploying any hydrodynamic structure, said hydrodynamic structure including pivoting flaps or rudder-like blades, when said watercraft is in close proximity of the sailing vessel.

8. An apparatus for establishing mechanical contact between a sailing vessel and a watercraft according to claim 7, wherein the contact established enables security personnel to board the vessel.

9. An apparatus for establishing mechanical contact between a sailing vessel and a watercraft according to claim 8, wherein the contact established enables the vessel to be tugged by the watercraft.

10. A watercraft for changing the direction of travel of a sailing vessel comprising:

(i) at least one moveable flap mounted on at least one of aside of the watercraft, a bottom of the watercraft and a fore or aft section of the watercraft;

(ii) at least one drill means for mechanically attaching said watercraft to said sailing vessel; and (iii) at least one internal ballast tank contained within the watercraft;

wherein, when the watercraft is in close proximity of the sailing vessel, it is attached to the sailing vessel, the at least one internal ballast tank is opened to submerge the watercraft alongside the sailing vessel, and the at least one moveable flap is moved to a position to at least one of retard forward movement and change the direction of travel of the sailing vessel.

11. A watercraft for changing the direction of travel of a sailing vessel comprising:

(i) at least one moveable flap mounted on at least one of a side of the watercraft, a bottom of the watercraft and a fore or aft section of the watercraft;

(ii) at least one vacuum suction means for mechanically attaching said watercraft to said sailing vessel; and (iii) at least one internal ballast tank contained within the watercraft;

wherein, when the watercraft is in close proximity of the sailing vessel, it is attached to the sailing vessel, the at least one internal ballast tank is opened to submerge the watercraft alongside the sailing vessel, and the at least one moveable flap is moved to a position to at least one of retard forward movement and change the direction of travel of the sailing vessel.

12. A method of changing the direction of travel of a sailing vessel comprising the steps of:

(i) bringing a watercraft alongside the hull of the sailing vessel;

(ii) bringing the watercraft in electro-magnetic contact with the hull of the sailing vessel by activating at least one solenoid bank contained within the watercraft;

(iii) mechanically securing the watercraft to a hull of the sailing vessel;

(iv) at least one of retarding the travel and changing the direction of travel of the sailing vessel, by opening of at least one moveable flap of the watercraft; and (v) opening at least one internal ballast tank contained within the watercraft to submerge the watercraft alongside the sailing vessel.

13. A method of changing the direction of travel of a sailing vessel as claimed in claim 12, wherein:

at least one moveable flap is opened or lowered at the bottom and one moveable flap is opened at a side of the watercraft; and at least one flap at least one of the fore or aft section of the watercraft is moved from an inclined position to a horizontal position to expose a vertical wall at the fore or aft section, respectively, of the watercraft.

14. A method of changing the direction of travel of a sailing vessel as claimed in claim 12, wherein the step of mechanically securing the watercraft to a hull of the sailing vessel includes:

(i) triggering an explosive to create an opening in hull of the sailing vessel;

(ii) introducing a bolt secured to a shaft into the opening created in step (i);

(iii) rotating the shaft by means of a motor to wedge a collapsible sleeve against the hull of the sailing vessel, and to bring the hulls of the watercraft and the sailing vessel into close proximity; and (iv) shearing off shaft contained within the watercraft at a point of weakness along the shaft.

15. A method of changing the direction of travel of a sailing vessel comprising the steps of:

(i) bringing a watercraft alongside the hull of the sailing vessel;

(ii) mechanically securing the watercraft to the sailing vessel by activating at least one drill means and securing at least part of said drill means onto a web frame of the vessel's hull;

(iii) at least one of retarding the travel and changing the direction of travel of the sailing vessel by opening at least one moveable flap of the watercraft; and (iv) opening at least one internal ballast tank contained within the watercraft to submerge the watercraft alongside the sailing vessel.

16. A method of changing the direction of travel of a sailing vessel comprising the steps of:

(i) bringing a watercraft alongside a hull of the sailing vessel;

(ii) mechanically securing the watercraft to the sailing vessel by activating at least one vacuum suction means to securely attach said watercraft to the vessel's hull;

(iii) opening at least one internal ballast tank to submerge the watercraft alongside the sailing vessel; and (iv) at least one of retarding the travel and changing the direction of travel of the sailing vessel by opening at least one moveable flap of the watercraft.

17. A method for establishing mechanical contact between a sailing vessel and a watercraft, whereupon when said watercraft is in close proximity of the sailing vessel, said method comprising the step of deploying attachment means without deploying any hydrodynamic structure, said hydrodynamic structure including pivoting flaps or rudder-like blades, said attachment means comprising:

an electromagnetic attaching means as generated by a solenoid bank; and an explosive-propelled hull-piercing nut-and-bolt clamping means.

18. A method for establishing mechanical contact between a sailing vessel and a watercraft according to claim 17, wherein the contact established enables security personnel to board the vessel.

19. An apparatus for establishing mechanical contact between a sailing vessel and a watercraft according to claim 18, wherein the contact established enables the vessel to be tugged by the watercraft.

20. A method according to claim 17, wherein a plurality of the watercraft is deployed.

* * * * *